United States Patent [19]

Noguchi et al.

[11] Patent Number: 4,828,682

[45] Date of Patent: May 9, 1989

[54] COKING PROCESS

[75] Inventors: Kosaku Noguchi, Tokyo; Honami Tanaka; Heima Yamazaki, both of Osaka; Yoshiharu Ohmoto, Iwakuni, all of Japan

[73] Assignee: Koa Oil Company, Limited, Tokyo, Japan

[21] Appl. No.: 49,046

[22] Filed: May 12, 1987

Related U.S. Application Data

[62] Division of Ser. No. 882,971, filed as PCT JP84/00508 on Oct. 25, 1984, published as WO86/02662 on May 9, 1986, abandoned.

[51] Int. Cl.[4] ..... C10G 9/14

[52] U.S. Cl. ..... 208/131; 208/50; 208/106

[58] Field of Search ..... 208/131

[56] References Cited

U.S. PATENT DOCUMENTS

| | | | |
|---|---|---|---|
| 4,040,940 | 8/1977 | Hayashi et al. | 208/131 |
| 4,049,538 | 9/1977 | Hayashi et al. | 208/50 |
| 4,108,798 | 8/1978 | Sze et al. | 208/131 X |
| 4,247,387 | 1/1981 | Akbar | 208/131 X |
| 4,267,031 | 5/1981 | Hirabayashi et al. | 208/131 |
| 4,312,742 | 1/1982 | Hayashi | 208/50 |
| 4,404,092 | 9/1983 | Audeh et al. | 208/131 |

*Primary Examiner*—Glenn Caldarola

*Attorney, Agent, or Firm*—Wenderoth, Lind & Ponack

[57] ABSTRACT

This invention relates to a coking unit for producing coke articles of good quality from feed material heavy oils with a variety of properties and more specifically relates to a delayed coking unit comprising a heating furnace and coking drums connected in this sequence with piping. This invention is characterized in that an intermediate drum independently equipped with pressure and temperature controlling means is provided, said intermediate drum being small in volume in comparison with that of said coking drum, so that substantially all of the amount of products treated in said intermediate drum is supplied into the coking drum.

1 Claim, 1 Drawing Sheet

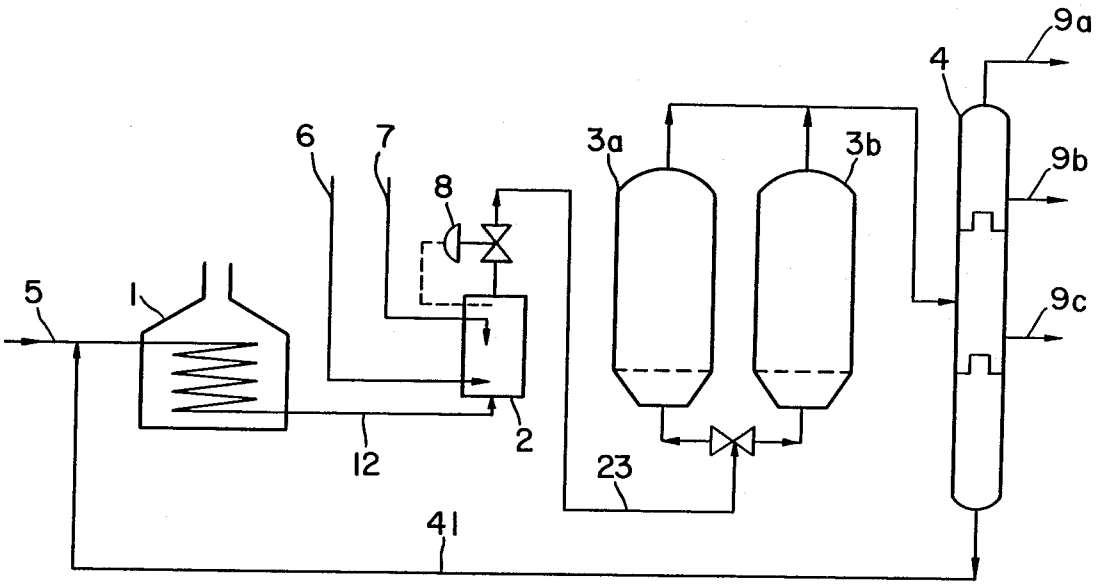
9a
9b
9c
4
3b
3a
23
2
8
7
6
12
41
1
5

COKING PROCESS

This application is a division of now abandoned application Ser. No. 882,971, filed as PCT JP84/00508 on Oct. 25, 1984, published as WO86/02662 on May 9, 1986, abandoned.

TECHNICAL FIELD

This invention relates to a unit for producing coke articles of good quality from heavy oils with a variety of properties as starting materials.

BACKGROUND ART

A delayed coking unit is extensively used for producing cokes from petroleum or coal heavy oils. The delayed coking unit, in general, basically comprises a heating furnace of feed material heavy oil and two or more coking drums which have been provided in parallel to each other and connected in series in this sequence, wherein the delayed coking process is carried out by feeding the heavy oil which has been heated to a thermal cracking temperature of 450°-500° C. into one of the coking drums by a pump, causing it to reside for a relatively long period, and accumulating coke produced by the cracking of the heavy oil within said coking drums, while oils resulting from the cracking are distilled out from the top of the drums.

However, the delayed coking process has a problem in that coke of high quality cannot be obtained from feed materials other than heavy oils of a definite quality, whereby a number of techniques for producing coke of good quality from a variety of feed material heavy oils have been proposed. These techniques include, for example: a process of previously subjecting a petroleum heavy oil to thermal cracking to an appropriate extent by means of a thermal cracking unit and supplying the resulting tar as a starting material or a part of the starting material to a coking drum (Japanese Patent Publication No. 33901/74, etc.); a process of using a clarified oil supplied from a catalytic cracking unit as a blended starting material oil (Japanese Patent Publication No. 18176/60, etc.); and a process for producing coke by using two coking drums arranged in series wherein coke of inferior quality is produced from the oil components of the starting material oil in earlier coking stages in the drum of the first stage, and coke of high quality is produced from the remaining oil components in the drum of the second stage (Japanese Patent Application Laid-Open No. 89902/73). The first and second processes described above are processes belonging to the province of the selection or pretreatment of the feed material oil, and the last one is a process which is primarily aimed at the removal of inferior components in the feed material oil, either of which processes is in general a technique characterized by controlling the composition of the feed material oil.

It may be said that this invention in a broad sense relates to the preparation technique of the feed material oil. An object of this invention is to provide a technique of producing coke of high quality from feed material oils having a variety of qualities by relatively simple alternation of a unit and the enlargement of the operation range in the reaction condition.

In the conventional delayed coking unit which has hitherto been used, a fluid which has been heated to a prescribed temperature in a heating furnace is merely transferred to a coking drum which is kept at a certain level of temperature. Further, the coking drum requires a huge volume in order to promote the desired thermal cracking and coking, and it is impossible in fact to heat such a huge coking drum and to control its temperature. Therefore, the coking drum is merely maintained at a natural temperature at which a balance is attained with the heat brought into the drum by the fluid which has been heated in the heating furnace. In other words, the temperature of the coking drum depends on only the temperature at the outlet of the heating furnace. The operation variable factors include additionally the flow rate and pressure of the feed material oil, but the operation ranges of these factors in actual industrial production are limited to such narrow ranges by design restrictions that these factors cannot be freely varied to improve effectively the quality of the coke product.

Meanwhile, the present inventors, as a result of engagement and researches in the production of coke over a long period of years, have found that the quality of the coke article is influenced very seriously not only by the temperature condition in the coking drum but also by the coking or thermal cracking condition of the feed material oil in the earlier stages, particularly the thermal cracking condition in the pathway from the heating furnace to the coking drum. That is to say, it has been found possible to control the quality of coke not by controlling the reaction condition in the coking drum which is difficult to control but by controlling the preliminary thermal cracking condition. Further, the preliminary thermal cracking process is completed in relatively short time, so that its control is distinguishedly simple in comparison with the control in the huge coking drum.

DISCLOSURE OF THE INVENTION

The coking unit according to this invention is grounded on such knowledge, and more particularly this invention relates to a delayed coking unit comprising a heating furnace and coking drum connected in this sequence by piping, wherein an intermediate drum which is small in volume compared with said coking unit and equipped with an independent pressure and temperature controlling means is provided, so that the substantially total amount of the treated product in said intermediate drum is supplied to the coking drum.

BRIEF DESCRIPTION OF THE DRAWING

The drawing is an arrangement diagram of the coking unit according to an example of this invention.

BEST MODE OF PRACTICING THE INVENTION

This invention is now explained below in more detail with reference to the drawing.

The drawing is an arrangement diagram of the coking unit according to this invention. This unit comprises a heating furnace 1, an intermediate drum 2, a pair of coking drums 3*a* and 3*b* which are arranged in parallel and a fractionating column 4 arranged substantially in series by piping 12, 23 and 34. A tank of the feed material heavy oil (not shown) is connected to the heating furnace 1 through feeding pipe 5, to which piping 41 extending from the bottom of the fractionating column 4 is connected. A superheated steam introducing pipe 6 and a cooling oil introducing pipe 7 are respectively connected to the lower and upper parts of the intermediate drum 2. A pressure controlling valve 8 is also provided in the outlet piping of the intermediate drum 2. The intermediate drum 2 has a volume preferably of 1-5% in proportion to that of the coking drum 3*a* or 3*b*.

This invention is now explained referring to a typical operational mode of the aforementioned unit. First of all, the feed material heavy oil comprising a straight run residual oil of petroleum under ordinary or reduced pressure, residual oil of thermal cracking, coal tar or the like is fed from the piping 5. It is heated to a temperature of 450°-500° C. in passing through the heating furnace 1, then introduced into the intermediate drum 2, where it is subjected to preliminary thermal cracking within a residence time of 100-300 seconds. When the outlet temperature of the heating furnace 1 is too low in comparison with the preliminary thermal cracking temperature of the feed material oil used, the content is heated by introducing superheated steam or the like from the piping 6. When the temperature is too high, the content is cooled by introducing a cooling oil which has been heated to a temperature lower than that, from the piping 7. Another controlling of the temperature is conducted not at the outlet of the heating furnace 1 but in the intermediate drum 2, because factors such as volume, heating pattern and the like in the heating furnace 1 which have been set up to the standard feed material oil cannot be changed following the alteration of the feed material oil, thus sometimes giving rise to the case wherein an ideal preliminary thermal cracking condition cannot be achieved only by the heating furnace 1.

Further, the pressure in the intermediate drum 2 is controlled to a pressure of 5-30 kg/cm$^2$G which is equal to or higher than the pressure in the coking drums 3*a*, 3*b* by the control valve 8. As shown in Examples hereafter, it has been found advantageous for the improvement of the quality of coke articles to increase the pressure on the preliminary thermal cracking within a defined range (see Examples shown below). The controlling of the pressure in the intermediate drum 2 has the effect of not only controlling the pressure as the preliminary thermal cracking condition but also of controlling the residence time in the intermediate drum 2. Furthermore, the volume of the intermediate drum 2 is much smaller than the volumes of the coking drums 3*a*, 3*b*, and thus it is very advantageous to conduct the pressurizing of the initial thermal cracking in the intermediate drum 2 but not in the coking drums 3*a*, 3*b* on the basis of the cost of the pressure vessel.

The heavy oil subjected to the initial thermal cracking treatment in said intermediate drum 2 experiences further cracking and coking in the coking drums 3*a*, 3*b* as in the conventional delayed coking process. In other words, the heavy oil from the intermediate drum 2 is charged into one of the coking drums 3*a*, 3*b* at its bottom by way of a piping 23 and experiences successive cracking and polymerization during the period for overall 24-48 hours when the heavy oil gradually increases its volume and is maintained in the drum 3*a*. When the drum 3*a* is filled with the heavy oil, then it is introduced into the drum 3*b*. On the other hand, thermal cracking and coking are continued for a period of time in the drum 3*a*, and the coke drum overheat vapor is introduced through the piping 34 into the fractionating column 4, from the top and intermediate trays of which the cracked gas and light oil products are withdrawn as products via the piping 9*a*, 9*b*, 9*c*, and the like, and from the bottom of which column the heavy oil is circulated through the piping 41 into the upper stream of the heating furnace 1. After the oil has been retained for a required time in the drum 3*a*, the drum 3*a* is opened and the coke product is decoked.

The foregoing description refers to a preferred embodiment of the unit according to this invention, but it is also possible to conduct a variety of alterations within the scope of this invention. For instance while there are provided additional heating and cooling means in the intermediate drum 2 in the above example, it is sufficient that only one of the heating or cooling means be provided and that heating and cooling be conducted by indirect heat exchanging and not direct heat exchanging. Further, the intermediate drum 2 may be of any shape or construction as long as the aforementioned object is achieved. Therefore, the intermediate drum may have a pipe shape or be a pipe which is arranged in a coil form in addition to the aforementioned drum type.

As described above, according to this invention it is possible in a conventional delayed coking unit to set up an optimal initial thermal cracking condition following a variety of the alteration of feed material heavy oils by simple modification of the arrangement of the intermediate drum provided with an independent pressure and temperature controlling means, and it also becomes possible to improve the quality of a coke product obtained from the same feed material heavy oils.

Application effects of this invention are more specifically described with respect to Examples and Comparative Examples.

EXAMPLE 1

A coking unit on a scale of a pilot plant comprising two heating furnace equipped with heating tubes having an internal diameter of 3 mm and a length of 9 m, an intermediate drum having a volume of 2 liters which is connected with the heating furnace and a coking drum having a volume of 80 liters which is connected with the intermediate drum was constructed. The intermediate drum was provided with a high-temperature steam supplying device as a heating means, a quenching-oil supplying device as a cooling means and a control valve as a pressure-controlling means.

The properties of the feed material heavy oil are shown in Table 1. The same heavy oil as shown in Table 1 was also used in Example 2 and Comparative Examples 1 and 2 below.

TABLE 1

| | Residual Oil |
|---|---|
| Specific gravity (15/4° C.) | 0.9570 |
| Conradson residual carbon (% by weight) | 8.65 |
| Molecular weight | 540 |

The feed material heavy oil having such properties as above was charged into the heating furnace at the rate of 200 g/min., and delayed coking of the feed material heavy oil was conducted under the conditions shown in Table 2. The results are shown in Table 3.

EXAMPLE 2

The delayed coking of the same heavy oil as shown in Table 1 was conducted under the conditions shown in Table 2 in the same manner as in Example 1 except that the cracking pressure in intermediate drum was changed. The results are shown in Table 3.

COMPARATIVE EXAMPLE 1

A pilot plant similar to that in Example 1 except that no intermediate drum was provided was constructed, and the delayed coking of the feed material heavy oil was conducted under the conditions shown in Table 2 in the same manner as in Example 1. The results are shown in Table 3.

TABLE 2

| Experimental Condition | Example 1 | Example 2 | Comparative Example 1 |
|---|---|---|---|
| Temperature of heating furnace | 490° C. | 490° C. | 490° C. |
| Temperature of intermediate drum | 460° C. | 460° C. | — |
| Pressure of intermediate drum | 9 kg/cm$^2$G | 14 kg/cm$^2$G | — |
| Inlet temperature of coking drum | 460° C. | 460° C. | 460° C. |
| Pressure of coking drum | 5 kg/cm$^2$G | 5 kg/cm$^2$G | 5 kg/cm$^2$G |

TABLE 3

| Yield Gas Quality of Coke | Example 1 | Example 2 | Comparative Example 1 |
|---|---|---|---|
| Yield Gas | 5.7 | 6.4 | 5.6 |
| Gasoline | 6.9 | 6.2 | 5.7 |
| Light oil | 15.0 | 14.9 | 14.3 |
| Heavy oil | 58.0 | 58.6 | 60.8 |
| Coke (% by weight) | 12.4 | 12.9 | 11.9 |
| Properties of Coke | | | |
| Apparent density (g/cm$^3$) | 1.37 | 1.41 | 1.30 |
| C.T.E.* ($\times 10^{-6}$/°C.) | 1.4 | 1.3 | 1.6 |

*Coefficient of thermal expansion (to the grain direction) at a temperature of 30-100° C.

From the results shown in Table 3, it can be seen that in Examples 1 and 2 wherein initial thermal cracking is conducted in the pressurized intermediate drum 2, not only the cracking of the feed material oil progresses and the yields of light fractions (gas, gasoline and light oil) are improved in comparison with those in Comparative Example 1 wherein the conventional delayed coking process was conducted under optimal conditions for the feed material oil used, but also the apparent density of the coke product is improved, and coke of small coefficient of thermal expansion and good quality is obtained.

COMPARATIVE EXAMPLE 2

Using the pilot plant in Comparative Example 1 wherein no intermediate drum is provided, delayed coking of the feed material heavy oil was carried out at a heating furnace temperature of 490° C. and at a coking temperature of 460° C. In this case a pressure from 5 kg/cm$^2$ G to 7 kg/cm$^2$ G was used in the coking drum. The coke obtained had an apparent density of 1.25 and a C.T.E. of 2.0.

From the result, it can be seen that a coke having good properties is not obtained even if only the pressure in the coking drum is increased without the provision for an intermediate drum.

INDUSTRIAL APPLICABILITY

According to the coking unit of this invention, coke articles of good quality can be produced from feed material heavy oil having a variety of properties.

We claim:

1. A process for producing coke from feed material heavy oils which comprises the following steps:

(a) introducing said feed material heavy oils into a heating zone to heat said feed material heavy oils up to thermal cracking temperature in the range of 450° to 500° C.;

(b) introducing the thus heated heavy oils into an intermediate heat treating zone, the volume of which is 1 to 5% in proportion to the coking zone used in the following coking step (c), whereby it is subjected for a residence time in the range of 100 to 300 seconds to preliminary thermal cracking under controlled temperature while maintaining a pressure in the range of 5 to 30 kg/cm$^2$ G, which is controlled to be equal to or higher than the pressure in the following coking step (c); and (c) introducing the thus preliminary thermally cracked heavy oils into a coking zone, whereby it is subjected to heat treatment to obtain coke.

* * * * *